US007059935B1

(12) United States Patent
Jamshidi

(10) Patent No.: US 7,059,935 B1
(45) Date of Patent: Jun. 13, 2006

(54) BREASTFEEDING SUPPORT

(76) Inventor: Anita Jamshidi, 10113 Walker Woods Dr., Great Falls, VA (US) 22066

( * ) Notice: Subject to any disclaimer, the term of this patent is extended or adjusted under 35 U.S.C. 154(b) by 0 days.

(21) Appl. No.: 11/135,041

(22) Filed: May 23, 2005

Related U.S. Application Data

(60) Provisional application No. 60/574,335, filed on May 24, 2004.

(51) Int. Cl.
*A41C 3/00* (2006.01)

(52) U.S. Cl. ..... 450/54; 2/267

(58) Field of Classification Search ..... 450/54–57, 450/36, 38; 2/267, 268, 104; 623/7, 8
See application file for complete search history.

(56) References Cited

U.S. PATENT DOCUMENTS

| | | | | |
|---|---|---|---|---|
| 4,149,274 | A * | 4/1979 | Garrou et al. | 2/239 |
| 4,816,004 | A * | 3/1989 | Emanuel | 450/55 |
| 5,603,653 | A | 2/1997 | Hartman | |
| 6,237,599 | B1 | 5/2001 | Maulding | |
| 6,651,282 | B1 | 11/2003 | Skoug et al. | |
| 2001/0044968 | A1 | 11/2001 | Schmitter et al. | |
| 2002/0072295 | A1 | 6/2002 | Gatto et al. | |
| 2002/0146673 | A1 | 10/2002 | Aranas | |
| 2004/0029484 | A1 | 2/2004 | Smith | |
| 2005/0015883 | A1 | 1/2005 | Bartley et al. | |

* cited by examiner

*Primary Examiner*—Gloria M. Hale
(74) *Attorney, Agent, or Firm*—Gray, Plant, Mooty, Mooty & Bennett, P.A.; Peter Forrest

(57) ABSTRACT

An improved support for placement underneath a woman's breast, to comfortably maintain proper positioning of the breast to a nursing baby.

13 Claims, 2 Drawing Sheets

BREASTFEEDING SUPPORT

CROSS-REFERENCE TO RELATED APPLICATION

This application claims the benefit of provisional application No. 60/574,335 filed May 24, 2004.

BACKGROUND

As described in U.S. Pat. No. 6,237,599, there is a need for a cushioned support placed underneath a woman's breast, to comfortably maintain proper positioning of the breast to a nursing baby. The entire disclosure of U.S. Pat. No. 6,237,599 is incorporated by reference.

SUMMARY OF THE INVENTION

The invention is an improved cushioned support for placement underneath a woman's breast, to comfortably maintain proper positioning of the breast to a nursing baby. The support is generally shaped like a "wedge" shaped portion of an orange. The shape of the support helps ensure that it does not become dislodged from its position during extended periods of breastfeeding.

BRIEF DESCRIPTION OF THE DRAWINGS

The figures illustrate a preferred embodiment of the invention and thus it should be understood that minor changes in shape, proportion, size, and the like are not critical to the scope of the invention except as specifically noted elsewhere in this application.

FIG. 2 also shows the line 1—1, along which the perspective view of FIG. 1 is taken.

FIG. 3 also shows the line 1—1, along which the perspective view of FIG. 1 is taken.

DETAILED DESCRIPTION

In general terms, the invention is an improved version of the support roll disclosed in U.S. Pat. No. 6,237,599, and used in the same general manner as the invention described in that patent. The invention relies upon an improved shape to provide greater comfort, especially over long periods of breastfeeding, than the support roll disclosed in that patent. Thus, it should be understood that the text of that patent that is not specifically directed to the generally elliptical shape of that invention is, by being incorporated by reference into this application, also descriptive of this invention and therefore will not be repeated verbatim. For example, the discussion of the appropriate height of the baby compared to the elbow of the mother is equally applicable to this invention because it does not depend on the shape of the invention. Other disclosure, such as selection of fabrics and other materials, is similarly applicable to this invention except as specifically noted here.

The invention comprises an internal piece that is preferably a single unit of material, although multiple units assembled into the same shape as the single unit could be employed. The material of the interior piece is preferably a hypoallergenic memory foam, although other materials could be used provided the shape and cushioning properties of the invention are not lost. The interior piece is covered with close-fitting fabric to provide a soft feel against the underside of the breast and other skin. For this reason, exposed non-smooth seams in the fabric should be avoided (or located where they will not contact the skin in use). The exterior cloth also provides sufficient friction to maintain the invention in place. The preferred interior single foam piece, depicted in the Figures, is made of hypoallergenic viscoelastic memory foam, and the exterior cloth, not shown in the Figures, is preferably made of one-hundred percent soft cotton, but it can be another soft fabric (either natural or artificial or a blend of the same). It is preferred but not required that the support be washable and reusable instead of disposable.

Figure 1:
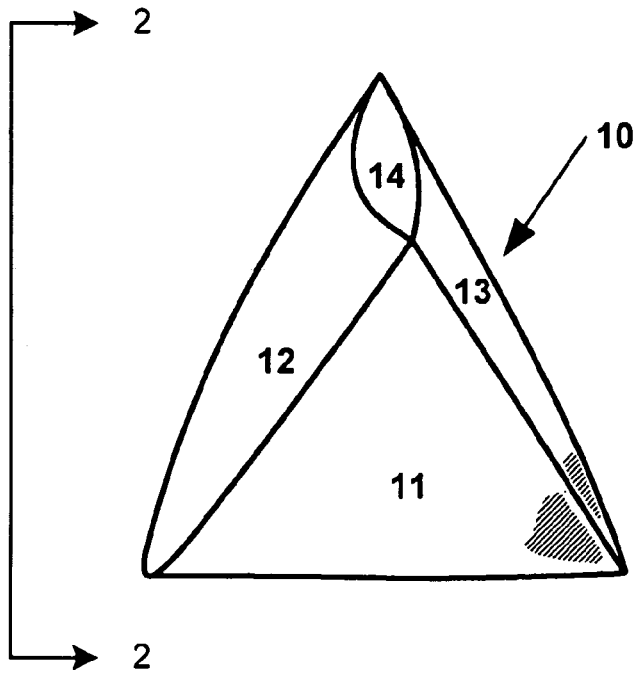
FIG. 1 is a perspective view of a preferred embodiment of the invention.
Figure 2:
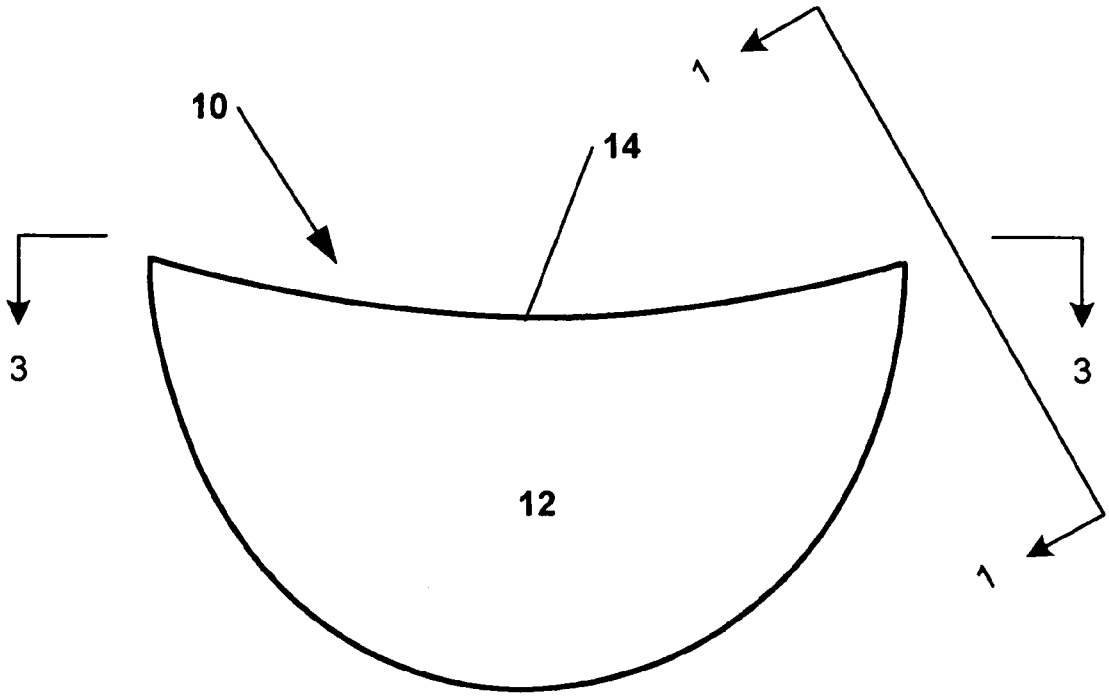
FIG. 2 is a side view of the preferred embodiment of FIG. 1, taken along the line 2—2 of FIG. 1.
Figure 3:
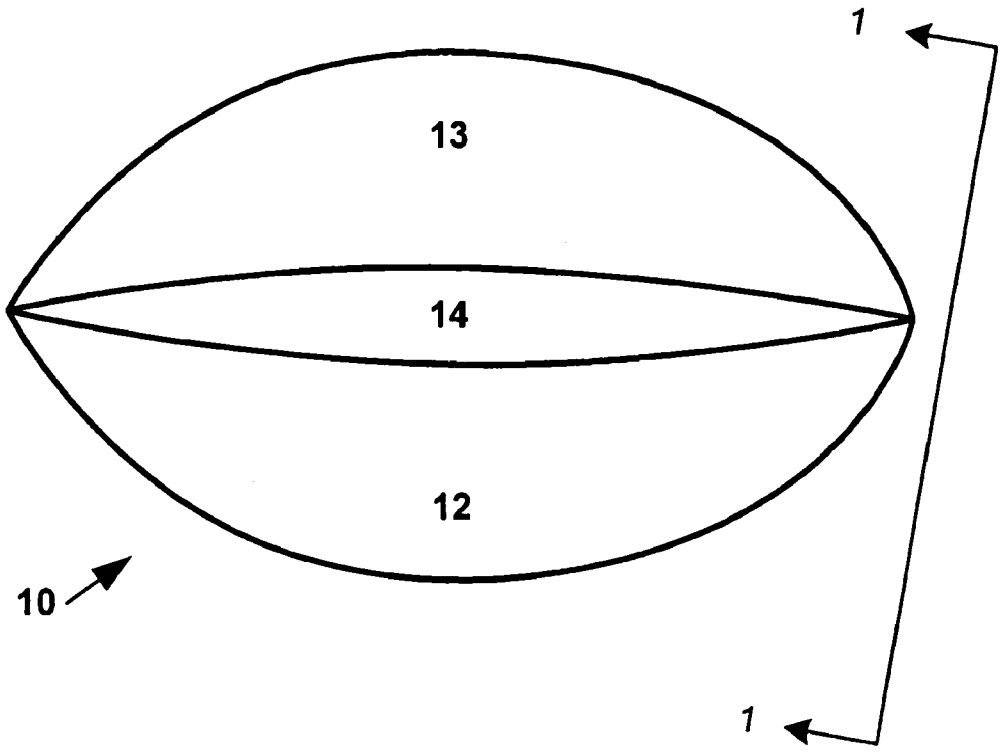
FIG. 3 is a top view of the preferred embodiment of FIGS. 1 and 2, taken along the line 3—3 of FIG. 2.
Figure 4:
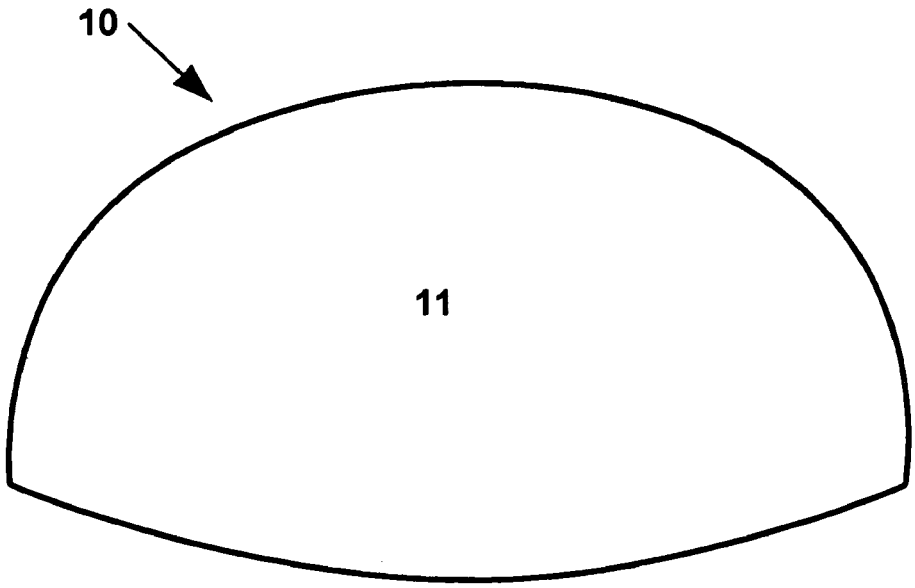
FIG. 4 is a bottom view of the preferred embodiment of FIGS. 1–3 when the invention is tilted onto one of its major planes.

As shown in the Figures, the shape of the interior piece 10 is generally that of a "wedge," or more properly a spherical segment, having a curved exterior surface 11 that lies between two flat plane surfaces 12 and 13. Unlike a complete spherical segment, in which the two plane surfaces 12 and 13 would meet at a line coinciding with the central axis of the sphere, a concave region 14 lies between the two plane surfaces 12 and 13 opposite curved exterior surface 11. Each of the two flat plane surfaces 12 and 13 is therefore, when viewed from the side as in FIG. 2, generally shaped like a waxing or waning crescent phase of the Moon (rotated by 90° for purposes of illustration only). The concave region 14 is formed by removing a piece of the interior piece 10 along the curved lines emphasized in FIGS. 1–3 (or by forming the curved piece so that the missing material is never present to begin with).

The exact size of the interior piece 10 is not critical to the invention, and can be determined by the person of ordinary skill in the art by considering the dimensions typically encountered in the anatomy of breastfeeding females. In preferred embodiments, a set of four sizes of the invention (small/medium/large/extra-large) may accommodate a set of pre-nursing bra cup sizes such as: C and D (small); DD and DDD (medium); F, FF, and G (large); and H and I (extra-large).

The invention is placed underneath the breast during breastfeeding with either of the two flat plane surfaces 12 and 13 against the chest and the other against the underside of the breast. In particular, one may simply hold the invention in the palm of one's hand, compress the invention with the thumb and fingers, position the invention at the curved underside at the base of the breast, and release the invention so that it returns to its original shape. This elevates and steadies the breast without the need for the mother to cup or otherwise hold the breast or nipple in her hand, thus placing the nipple in proper position for the infant to latch to the breast. The use of a support enables the mother to comfortably maintain this position for long periods of time without repeated readjustment of the position of support 10. In addition, the resilience of the support, due to the foam interior portion, provides greater comfort than other "soft" supports such as a rolled washcloth.

It is preferred but not required that the exterior cloth be textured in any convenient manner to keep the support 10 from slipping out of position. Such texture may be due to the fabric itself, or it can be added in the form of "dots" or other shapes of an added material similar to that used for non-skid socks, gloves, and the like. The texture is most appropriately present on at least one of the two flat plane surfaces 12 and 13, preferably both (so that either plane may lie against the chest or against the underside of the breast, at the mother's option), but it is possible to provide texture on all the entire exterior of support 10.

I claim:

1. A support for breastfeeding, comprising a curved exterior surface and a concave region, each of which lies between two flat plane surfaces, each flat plane surface being generally crescent shaped in outline, thus forming a generally wedge shaped support, the support being sized to elevate a breast when the support is placed between the underside of a breast and the chest during breastfeeding.

2. The support of claim 1 in which the support comprises an interior piece and a close-fitting fabric exterior piece.

3. The support of claim 2 in which the interior piece comprises a single piece of material.

4. The support of claim 2 in which the interior piece comprises multiple pieces of material.

5. The support of claim 2 in which the interior piece comprises a hypogenic viscoelastic foam material.

6. The support of claim 2 in which the close-fitting exterior fabric comprises cotton.

7. The support of claim 1 in which the support comprises disposable materials.

8. The support of claim 1 in which the support comprises washable and reusable materials.

9. The support of claim 1 in which the support further comprises at least one textured exterior surface.

10. The support of claim 9 in which any textured exterior surface comprises a non-skid material.

11. The support of claim 9 in which the textured exterior surface is one of the two flat plane surfaces.

12. The support of claim 9 in which the textured exterior surface comprises both of the two flat plane surfaces.

13. The support of claim 9 in which the textured exterior surface comprises the entire exterior of the support.

* * * * *